US005234172A

United States Patent [19]

Chupka et al.

[11] Patent Number: 5,234,172

[45] Date of Patent: Aug. 10, 1993

[54] HIGH PRESSURE WATER JET COMMINUTING

[75] Inventors: David E. Chupka; Peter Seifert; Christopher M. Vitori, all of Middletown, Ohio

[73] Assignee: The Black Clawson Company, Middletown, Ohio

[21] Appl. No.: 649,104

[22] Filed: Feb. 1, 1991

[51] Int. Cl.[5] ..... B26D 3/00; D21J 1/02

[52] U.S. Cl. ..... 241/301; 162/194; 83/53; 241/1

[58] Field of Search ..... 83/53, 177; 241/1, 301; 162/194

[56] References Cited

U.S. PATENT DOCUMENTS

| | | | |
|---|---|---|---|
| 2,860,550 | 11/1958 | Start . | |
| 2,888,073 | 5/1959 | Corbin et al. . | |
| 2,954,082 | 9/1960 | Moore . | |
| 3,011,733 | 12/1961 | Ford . | |
| 3,097,992 | 7/1963 | Strempel . | |
| 3,218,227 | 11/1965 | Moore . | |
| 3,236,723 | 2/1966 | Whiteside . | |
| 3,245,872 | 4/1966 | Nelson . | |
| 3,809,606 | 5/1974 | Stanbrey . | |
| 3,966,545 | 6/1976 | Banner . | |
| 4,106,980 | 8/1978 | Seifert et al. . | |
| 4,182,170 | 1/1980 | Grupp . | |
| 4,266,112 | 5/1981 | Niedermeyer | 83/53 X |
| 4,897,159 | 1/1990 | Bone et al. . | |
| 4,986,479 | 1/1991 | Swarden et al. | 241/152 R X |
| 5,031,496 | 7/1991 | Lobash et al. | 83/177 X |
| 5,035,362 | 7/1991 | Mazurkiewicz | 241/1 |
| 5,083,487 | 1/1992 | Croteau | 83/177 X |
| 5,115,983 | 5/1992 | Rutherford | 241/21 X |

FOREIGN PATENT DOCUMENTS

| | | | |
|---|---|---|---|
| 207069 | 12/1986 | European Pat. Off. | 83/177 |
| 1530874 | 3/1976 | United Kingdom . | |

*Primary Examiner*—Mark Rosenbaum
*Assistant Examiner*—Frances Chin
*Attorney, Agent, or Firm*—Biebel & French

[57] ABSTRACT

A cutter for comminuting a moving continuous sheet or web, such as paper broke, in the dryer or converter section of a papermaking machine, includes a plurality of high pressure water jet cutting nozzles positioned in a conduit section for receiving such broke from the papermaking machine. In one embodiment the nozzles are arranged in banks positioned to impact the sheet as it passes through the conduit section, from opposite sides, and are mounted on water conduits which, in turn, are mounted for reciprocating movement and are oscillated transversely of the direction of sheet movement by a mechanical drive. The cutting jets from the high pressure nozzles impact the sheet simultaneously at opposite sides, while being reciprocated to reduce the sheet into a multiplicity of smaller discrete or easily separable pieces which fall through the bottom of the conduit section, for further processing or disposal. The nozzles may be directed at an angle to the direction of sheet movement, so as to impart a force component tending to pull the sheet through the conduit section. In another embodiment, an open face roll forms a backing support for the sheet and a mutually reciprocating pair of nozzle banks have cutting jet sprays directed against and through the sheet supported on the open face roll.

13 Claims, 4 Drawing Sheets

HIGH PRESSURE WATER JET COMMINUTING

BACKGROUND OF THE INVENTION

This invention is directed to a method and apparatus for handling and cutting sheet or web-type materials, such as broke, on a papermaking machine, by high pressure liquid cutting jets.

For example, in broke handling, when a break occurs somewhere along the line in a papermaking machine, it is necessary to cut the sheet off and divert it for disposal. Typically, the newly formed paper web, at the wet end of the machine, may be broken up or disintegrated by a plurality of transversely positioned, low-pressure showers. Such stripper or shower arrangements for disintegrating a newly formed web as broke material are shown in Moore, U.S. Pat. No. 2,954,082 issued Sep. 27, 1960; Nelson, U.S. Pat. No. 3,245,872 issued Apr. 12, 1966; and Strempel, U.S. Pat. No. 3,097,992 of Jul. 16, 1963. While low pressure knock-off showers have been successfully used at the wet end, they are not used at the dry end of the machine for handling broke due to the substantially increased strength of the paper web after one or more pressing and drying stages.

The prior art shows various broke handling apparatus between or at the end of dryer sections for receiving and sometimes cutting, or mechanically reducing the web before or after it is delivered through a hole in the floor to a basement receiving or conveying system. Thus, Ford, U.S. Pat. No. 3,011,733 issued Dec. 5, 1961 illustrates a broke-receiving hole, otherwise known as a broke hole, for receiving a leading edge of such broke, including apparatus intended to wind the broken web piece upon a temporary storage or cutting drum without further cutting or size reduction.

Corbin et al, U.S. Pat. No. 2,888,073 issued May 29, 1959 describes an arrangement for laterally conveying broke at the press section of a papermaking machine by delivering the paper to one side of the machine without the use of a broke hole. A water jet slitter positioned at the off-running end of the forming wire cuts the green broke as it leaves the wire and before it engages the transverse doctor, for removing the broke from the press section.

Stark, U.S. Pat. No. 2,860,550 issued Nov. 18, 1958 illustrates a mechanical conveyor arrangement by which sheets of broke are delivered from the broke hole to a basement pulper.

Typically, when a break occurs in the press or dryer section, the web is first cut by a flying knife which traverses the web to separate it from the remaining web, and a deflector or doctor blade directs the now cut web toward a broke hole, or otherwise into slitting or conveying apparatus. A partially dried or green web has also been severed by a high pressure water jet arrangement as shown in Grupp, U.S. Pat. No. 4,182,170, where a pair of oppositely positioned water jets are pivotally mounted to move in a cutting direction transverse to the plane of the running web. The jets are moved to make a single cut across the web and to sever the web.

After the broke has been severed, it is desirable to cut it up into smaller pieces to assist in moving the broke out of the way and for further processing. An arrangement for mechanically shredding the broke into smaller chevron-shaped pieces immediately under the broke hole, and for hydraulic delivery to a pulper, is shown in Whiteside, U.S. Pat. No. 3,236,723 issued Feb. 22, 1966. In Whiteside, a rotary toothed cutter operates in conjunction with a bed knife to shred the broke sheet as it is delivered through the broke hole, for subsequent delivery to conveying and re-pulping apparatus.

Broke reducing or comminuting systems have not been widely adopted for handling broke the dryer sections of from board machines. More likely, the board is simply allowed to drop into a pit, or is pulled off to one side of the machine and then handled manually or with a fork lift truck for disposal. The stiffness of the material and its weight often require the application of extreme measures in removing the broke from the floor and disposing of the same.

The present systems of handling broke at the dryer section of a papermaking machine are generally characterized best by cumbersome mechanical apparatus. A need exists for a high speed, lightweight and effective broke cutting and size reducing apparatus and method, for dried or partially dry paper webs.

SUMMARY OF THE INVENTION

This invention is directed to new concepts in web comminuting and handling, to reduce a sheet or web of material into small discontinuous pieces to facilitate disposal or further processing. One example is that of handling broke in all kinds of papermaking machinery.

The invention is directed to apparatus and methods by which a web or moving continuous sheet of such material is reduced. The material may be anything which is subject to liquid jet cutting such as paper, paperboard, fabric, felt, plastic or the like, and the preferred embodiments are described in terms of paper broke.

In a preferred embodiment, the broke is acted upon by a plurality of transversely spaced and oscillating cutting jets which reduce the broke into relatively small pieces. In this preferred embodiment, banks or arrays of water cutting nozzles are positioned at opposite sides of a broke pathway, and arranged for impingement of cutting jets at the opposite sides of the broke.

The web is directed into the water jet cutting path in a hanging, generally downward movement from the off-running side of a roll, and since it is acted upon by opposed banks of nozzles, the jets define, in effect, an open broke pathway therebetween. The impact energy of the jets is substantially equally divided between each side of the web, thereby guiding the broke in a free-fall manner between the banks of nozzles. Additionally, by angling the jets in the direction of broke travel, energy is imparted to the web, while, at the same time, it is shredded or cut, and this energy may be directed such that the web is literally pulled downwardly from the roll directed into a broke pit or a waiting container.

Since the broke is cut by opposed sets or groups of water jet nozzles, the required liquid or water pressure for cutting may be substantially reduced from that which is conventionally used in operating a water knife. For example, conventional water knives for slitting or cutting a dry web are typically be operated from a source of water pressure in excess of 30,000 psi, requiring the use of extraordinarily expensive and high technology pumping and fluid handling components. A much lower pressure is employed in the practice of this invention.

In another aspect of the invention, one of the nozzle banks may be replaced by an open face supporting or backing roll. A pair of groups of water jet cutting nozzles, mounted for mutual relatively reciprocating movement, direct cutting streams against the broke sheet supported on an open face roll, such as a grooved or wire mesh backing roll. The open face backing roll provides a pathway for the movement of the broke, and at the same time, provides passageways permitting the cutting jets to pass through the broke so that the cutting efficiency is not impaired.

The broke handling arrangement of this invention effectively shreds the broke using water pressures of 5,000 psi or less, with effective results in slicing or cutting obtained at pressures at 1,500 psi or less. As a result, the pumping and fluid handling components may be made at much lower cost and with a substantially increased safety factor. One factor which permits the use of remarkably lower water pressures is believed to be the result of the use of opposed jets working against a sheet in a preferred form of the invention. Also, the use of jet orifices which are somewhat larger in diameter than those conventionally used in extreme high pressure cutting arrangements compensates for the loss of velocity by the increase in mass of the water jet.

In a broader aspect of the invention, a cutter for comminuting a moving continuous sheet of woven or felted material employs two or more sets of liquid jets which are arranged across the width of the sheet and are directed against or toward the sheet. At least one of the jet sets moves in fashion that a cutting path in the sheet is formed by the moving jets which cooperates with the paths cut the other jets so as to comminute or reduce the continuous sheet into discontinuous or easily separated pieces. Preferably, one or more of the sets of jets are mounted on a pipe which is caused to oscillate laterally at an amplitude such that the cutting paths of the jet sets cooperate to form the small discontinuous pieces. Where two such sets of jets are employed, the jets may be equal in number and spaced opposite each other with respect to a path of movement of the web and aimed toward each other, and both sets may be oscillated transversely 180° out of phase with amplitudes relating to the spacing whereby the combined amplitudes of oscillation is approximately equal to the nozzle spacing or is slightly less than the nozzle spacing, such as 0.9 S, where S is the nozzle spacing.

It is accordingly an object of this invention to provide apparatus and method by which a moving web of sheet material may be comminuted, by employing opposed liquid jet cutting nozzles defining a path therebetween, together with means for reciprocating, oscillating or moving at least one of the nozzles relative to the path for comminuting the web.

Another object of the invention is the provision of a system and method, as outlined above, in which opposed banks of cutting nozzles, in a reducing chest or box, are oriented to assist in the pulling of the broke from a dryer roll or the like.

A more particular object of the invention is the provision of a sheet or web cutting or handling arrangement and method which includes a plurality of high pressure jets positioned in spaced relation transversely of the moving sheet and mounted at least for mutually transverse or oscillating movement in relation to each other for shredding the sheet into small pieces, and providing for delivery of the pieces such as into a broke-receiving region, chest, or conveyor. The nozzles may be positioned at one side of a sheet supported by an open face backing roll, or the nozzles may be opposed to each other on opposite sides of a moving sheet.

Another object of the invention is the provision of a broke commuting apparatus and method, in which a plurality of cutting nozzles are operated at a relatively low water pressure, such as 5,000 psi or less.

These and other objects and advantages of the invention will be apparent from the following description, the accompanying drawings and the appended claims.

BRIEF DESCRIPTION OF ACCOMPANYING DRAWINGS

DESCRIPTION OF PREFERRED EMBODIMENTS

Figure 1:
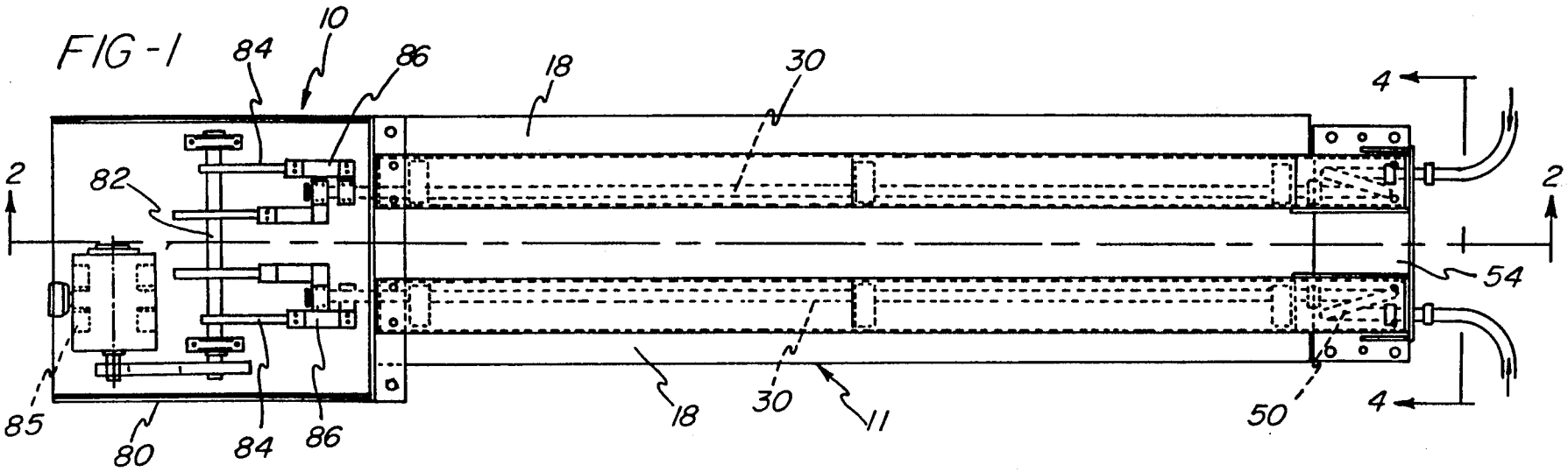
FIG. 1 is a top plan view of a broke cutter in accordance with this invention.
Figure 2:
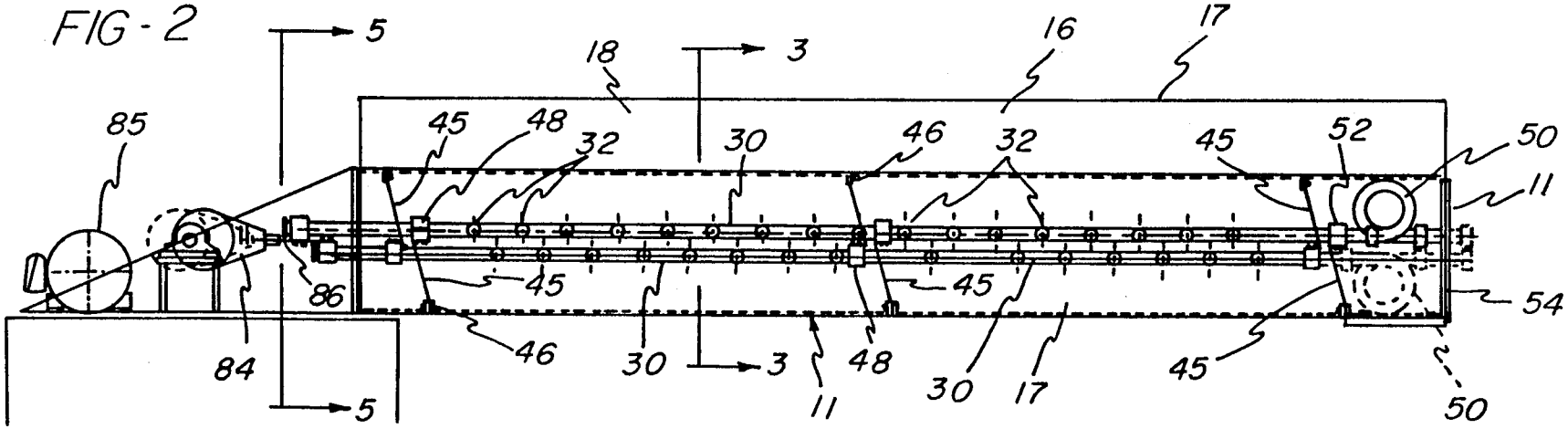
FIG. 2 is a transverse section through the cutter looking generally along the line 2—2 of FIG. 1 and showing two of the banks of cutting nozzles and the suspension arrangements therefor.

Referring to the figures of the drawing, which illustrate preferred embodiments of the invention as applied to the handling of paper broke, a cutter for receiving a moving continuous sheet of partially or fully dried broke from a roll, such as a dryer roll, is illustrated generally at 10 in FIGS. 1 and 2. It will be understood that the cutter 10 is positioned in a paper mill, in a dryer section for example, to receive a sheet of broke from the off-running side of a roll, such as a dryer roll. The effective lateral width of the cutter 10 is at least that of the web under which it is mounted.

For the purposes of this application, the cutter 10 is described in terms of receiving broke from the off-running side of a dryer roll, although it is within the scope of this invention to use the broke cutter and method in the press section or at a converter section, such as at a calendar or the like. The previously identified patent of Ford, U.S. Pat. No. 3,011,733 shows a broke handling arrangement at the last dryer roll of a dryer section, although a plurality of broke receiving positions may be defined on a paper machine, as shown in FIG. 16 of Whiteside, U.S. Pat. No. 3,236,723, and is well known and understood in the art.

The cutter 10 of this invention preferably includes a transversely positioned conduit section 11 which defines a path 15 (FIG. 3) of movement for the sheet therethrough. The conduit section 11 may be formed of sheet metal walls with an open top 16 which is adapted to receive broke from the off-running side of a roll, or the like, and an open bottom 17 in which the cut pieces of broke may fall or be delivered through a broke hole to a suitable container or conveyor for disposal or for further processing. The open top 16 may be surrounded by sloping side walls 18 which form a funnel or trough for guiding the free end of the broke sheet into the conduit section 11 of the cutter 10.

Figure 3:
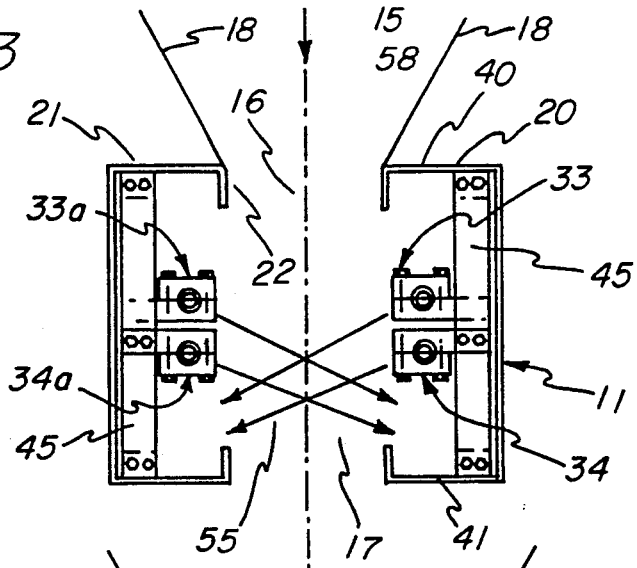
FIG. 3 is a vertical section through the cutter taken generally along the line 3—3 of FIG. 2.
Figure 4:
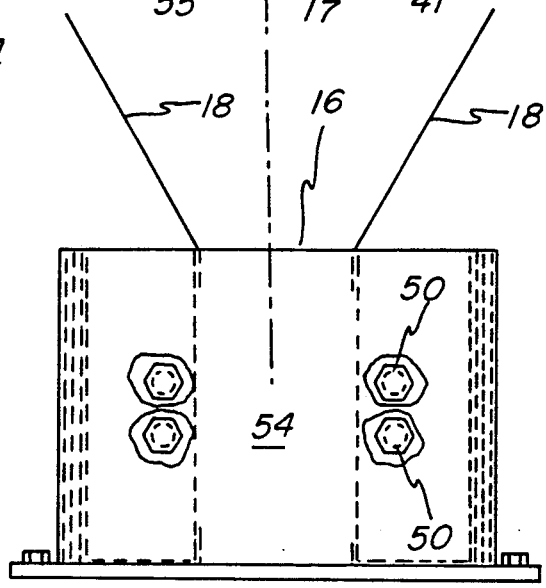
FIG. 4 is an end view of the cutter looking generally along the line 4—4 of FIG. 1.
Figure 5:
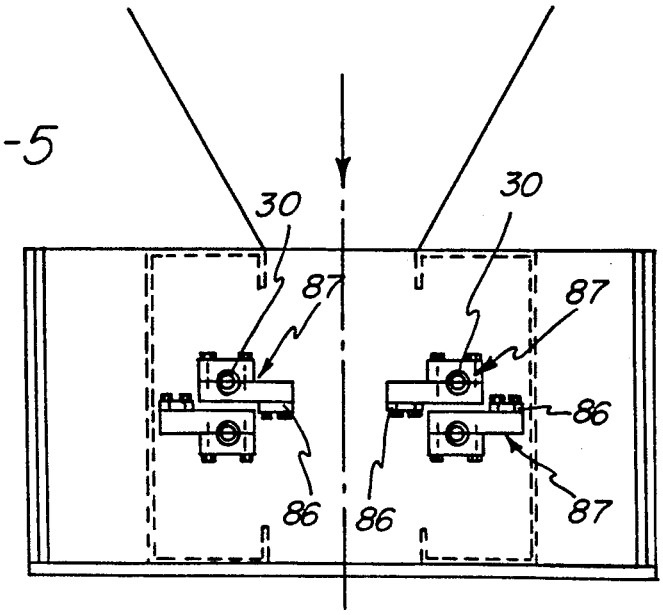
FIG. 5 is a sectional view looking generally along the line 5—5 of FIG. 2.

The details of the conduit section 11 may be further understood by reference to the end views of FIGS. 4 and 5 and the sectional view of FIG. 3. The conduit section 11 may advantageously be formed by a pair of mutually facing generally U-shaped or channel-shaped sheet metal sides 20 and 21, having inwardly turned lips 22 and with an open space defined between the lips. The channel members 20 and 21 support opposed pairs of banks of broke-cutting nozzles. Each bank includes a transversely elongated water pipe or conduit 30, and a plurality of individual jet-cutting nozzles 32 mounted in laterally and equally spaced relation along the conduit. Four banks are illustrated, an upper bank 33 and a lower bank 34, on one side of the pathway 15, and an upper bank 33*a* and a lower-bank 34*a* on the opposite side.

Figure 6:
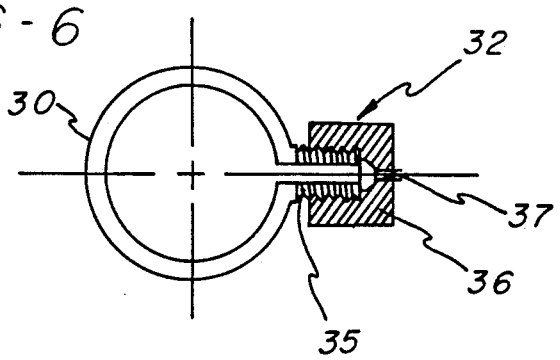
FIG. 6 illustrates one of the water jet cutting nozzles mounted on the support conduit.

Each bank includes an elongated conduit pipe 30 on which are mounted the jet nozzles 32, as shown in FIG. 6. The pipes 30 extend generally across the lateral width of the section 11. For convenience of construction, each bank may have the same number of nozzles at the same transverse spacings along the pipe 30.

A nipple 35 is secured by welding to the outer surface of the conduit 30, with a central opening therethrough leading into the interior of the conduit 30, and a cap 36 defines a round nozzle orifice 37 in alignment with the central opening. Such water jet cutting nozzles may be acquired from a number of known commercial sources for such nozzles. However, it is preferred to use nozzles with a central orifice diameter which is somewhat greater than that of conventional water jet cutting nozzles, for the purpose of increased mass of water at a lower water pressure, as described below.

Each of the nozzle banks may be more or less identical in construction with the other nozzle banks except that the upper pair of the banks 33, 33*a* are suspended from an upper wall 40 of one of the side channels 20 or 21 while the lower pairs of banks 34, 34*a* are suspended from the lower wall 41. The nozzle banks are independently suspended from each other for transverse oscillatory movement within the conduit section 11, such as by mounting the banks on suspension springs 45. As perhaps best shown in the sectional view of FIG. 2, each of the nozzle banks is mounted from either the upper wall 40 or the lower wall 41 on three identical suspension springs 45, although a fewer or larger number of such springs may be employed. The remote end of each spring 45 is connected to an internal bracket 46 which is fixed and stationary with the conduit section, while the opposite end of the suspension spring is carried on a block 48 mounted on the associated conduit 30.

While the suspension springs 45 provide an effective and energy efficient means of supporting each of the nozzle banks for limited transverse oscillatory movement within the conduit section 11 of the cutter 10, the conduits may be otherwise suitably mounted, such as on simple slide bearings, with equally effective results. Further, it may be understood that the opposed support pipes or conduits defining the nozzle banks are oscillated at 180° out of phase. The amplitudes of oscillation need not be identical, but it is important that when the amplitudes are combined that they are at least equal to or exceed $0.9 \times S$, where S is the spacing between the nozzles.

Means for supplying water, under pressure, to each of the nozzle support conduits or pipes 30 include a flexible connecting hose 50 connected at an end of a conduit as shown in FIGS. 1 and 2. One end of the hose is joined by a coupler 52 to a conduit 30 while the other end of the hose 50 extends through an end wall 54 of the cutter 10, for connection to a suitable source of water under pressure. The pressure source may advantageously include a water pump and a pressure accumulator (not shown), the output of which may be connected to the coupling hoses 50, through a suitable manifold, and controlled by a solenoid valve, so that pressure may be admitted to each of the nozzle banks at the same time that the broke is deflected into the hopper for passage through the pathway 15.

The individual nozzles 32 of each of the banks are positioned with respect to the water conduit pipe 30 so as to spray cutting jets in relatively parallel aligned paths. These spray paths, as shown by the arrows 55 in FIG. 3, are directed diagonally across the pathway 15 of the conduit section 11. Preferably, the two top banks 33, 33*a* of nozzles are directed so as to form substantially intersecting spray paths, and trace the same or approximately the same cutting line from opposite sides of the pathway 15. The same condition is true for the spray paths defined by the lower banks 34, 34*a* of nozzles. Water pressures which are lower than those ordinarily found in water knives may be used since any particular region on the broke is impacted by a cutting spray coming from opposite sides, and since the water mass is increased by using nozzle orifices of increased diameters.

As explained above, it is not necessary that the jets directly impinge against each other, as this condition would be difficult to maintain due to the very narrow streams which are emitted by the nozzles. Rather, it is merely only necessary that the opposing streams pass fairly close to each other, so that it can be said that they trace substantially the same lines of cut. The opposing forces imparted upon the broke by an opposed pair of nozzles are substantially balanced on the sheet, even though these forces may be applied at slightly differing positions with respect to the plane of the web.

The nozzles 32 are preferably angled somewhat in the direction of movement of the broke, as shown by the arrows 55 of FIG. 3. Thus by angling the nozzles downwardly, a resultant downward force component provides a positive tension to the broke, tending to pull the broke off of the proper machine roll and through the slot defining the broke pathway 15, as shown by the arrow 58. Additionally, the focus of the opposed banks of nozzles generally causes the broke to assume a central or neutral position within the conduit section 11, as defined by the pathway 15, as the broke is being cut by the oscillating banks into small sections or pieces. The water sprays from the nozzle banks at one side are caught in the trough defined by the channel members 20 or 21 at the other side, and suitably drained away out of the basin or space formed by the lower walls 42 and the lips 22. The open space formed between the lips may be protected by or screening to prevent the accumulation of broke in the exposed interiors of the channels members 20, 21.

Means for oscillating the nozzle banks relative to each other on their suspension springs may include an eccentric mechanical drive as shown generally at 80 in FIGS. 1 and 2. The drive 80 may include a common shaft 82 on which are mounted four eccentric cranks 84. A motor 85 causes the shaft 82 to rotate. The cranks 84 have crank arms which are connected, respectively, to one of the nozzle banks through a connector strap 86 and a pipe clamp 87. Preferably, the strap 86 is somewhat flexible to allow the individual conduits defining the banks to ride on their respective suspension springs 45, while permitting some flexing between the banks and the cranks 84.

It will also be seen that two of the crank arms are positioned relatively in 180° location to the others such that the two top banks 33, 33*a* move in unison, together, in one oscillatory direction, while the two bottom banks 34, 34*a* are caused to move in unison in the opposite direction. It is however, within the scope of the invention to move fewer than all of the sets of banks to provide a cutting action, and to move them in a pattern other than one which is 180° from the other. The nozzle bank spring suspension and the drive 80 need only move the banks relatively a distance which substantially equals but need not exceed the lateral spacing distance between adjacent nozzles.

Figure 7:
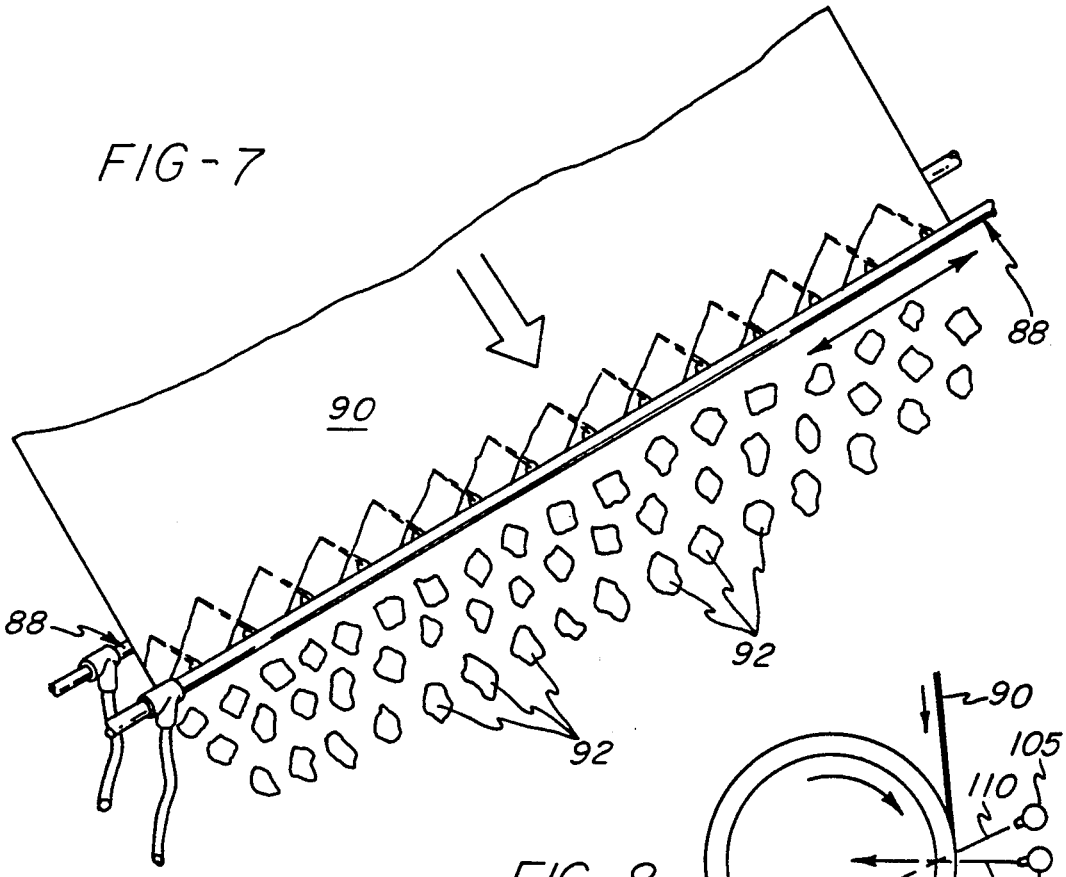
FIG. 7 is a diagram showing the disintegration and cutting of a sheet of broke as it passes between opposed banks of nozzles.

FIG. 7 diagrammatically illustrates the cutting action of the present invention employing for the purpose of illustration only single banks 88 of laterally spaced nozzles 32 at each side of the path of the broke. It will be seen since the nozzles reciprocate in a linear manner, in opposition to a corresponding reciprocation by the opposite bank, that the broke 90 is cut in more or less diamond-shaped individual pieces 92. The downward component of the nozzle paths 55, as shown in FIG. 3, provide a pulling effect on the sheet of broke, assuring it passage through the cutter and through the broke hole or into a container, as the case may be.

The start signal which operates the motor 85 may also be the signal which delivers high pressure cutting water to the manifold or inlet tubes connecting the fluid conduits. In appropriate cases, the motor 85 may also be the motor which could operate a water pressure pump of sufficient capacity to bring the pressure up to at least about 1,500 psi in the water conduits rapidly and providing for the rapid cutting and disintegration of the broke.

It will be understood that a preferred nozzle bank arrangement includes a pair of upper banks with nozzles which form mutually impinging streams which reciprocate and a pair of lower banks which likewise have nozzles arranged to provide mutually impinging streams. The transverse hydraulic forces are thus substantially balanced, one against the other, in the plane defined by the path of broke movement, again, while exerting a net downward force on the broke, as previously described.

Without limiting the scope of the invention, broke from the dryer section of a board machine, moving at between 500 and 1,000 feet per minute, may be cut by nozzles, as described herein, having orifices 37 of 0.020" diameter at 1,500 psi water pressure, and rotating the drive shaft 82 at 500 rpm to product 1,000 cutting strokes per minute, for each of the two pairs of banks. The cut pieces are of fairly uniform size and dimensin, and freely out through the open bottom or outlet 17 of the conduit section 11. A further conduit may be attached, for delivery either gravitationally, pneumatically, or water assisted, to a remote location, for further processing or disposal.

Figure 8:
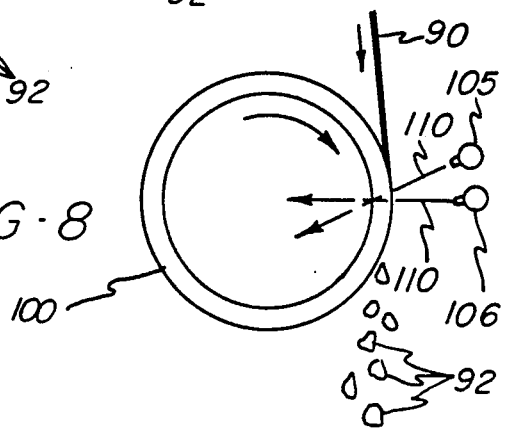
FIG. 8 is a diagrammatic side view of an embodiment of the invention in which an open face backing roll supports the broke sheet.

As previously mentioned, the sheet 90 of broke material may be supported by an open face roll 100 as shown in FIG. 8 and acted upon by a pair of mutually or relatively reciprocating shower banks 105 and 106. The open face roll 100 may thus be positioned so that its outer surface defines the path of movement of the broke from an off-running roll of the paper machine as in the case of the conduit section 11 of the cutter 10 of the preceding embodiment. A typical open face roll is shown, for example, in the patent of Seifert et al, U.S. Pat. No. 4,106,980 issued Aug. 15, 1978 and assigned to the same assignee as this invention. Thus, the open face roll may be a typical honeycomb roll, a wire mesh roll, a grooved roll or a perforated screen roll as shown in the Seifert et al patent.

The nozzle banks 105 and 106 may be constructed with a rigid conduit section and flexible coupling, with individual laterally spaced nozzles directed essentially to a common peripheral region on the open face roll 100 similarly to the nozzle bank 88 of the diagram of FIG. 7. The nozzle banks 105 and 106 are reciprocated one relative to the other, with mutually impinging jet streams 110, as illustrated, against the sheet 90 on the open face roll 100. Since the jet cutting streams can penetrate the open face roll, the streams go through the sheet, and the sheet 90 is shredded into smaller pieces 92. The support and mounting for the shower banks 105 and 106 may be that which has been described in connection with the embodiment of FIGS. 1–5, and the individual nozzles 32 may be as shown in FIG. 6.

Figure 9:
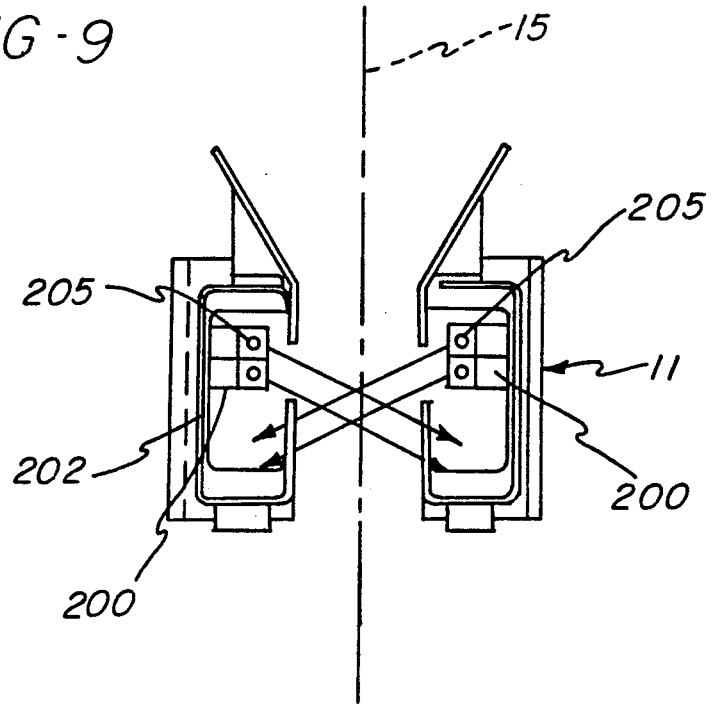
FIG. 9 is a sectional view similar to FIG. 3 showing a modified support arrangement for the conduit pipes.
Figure 10:
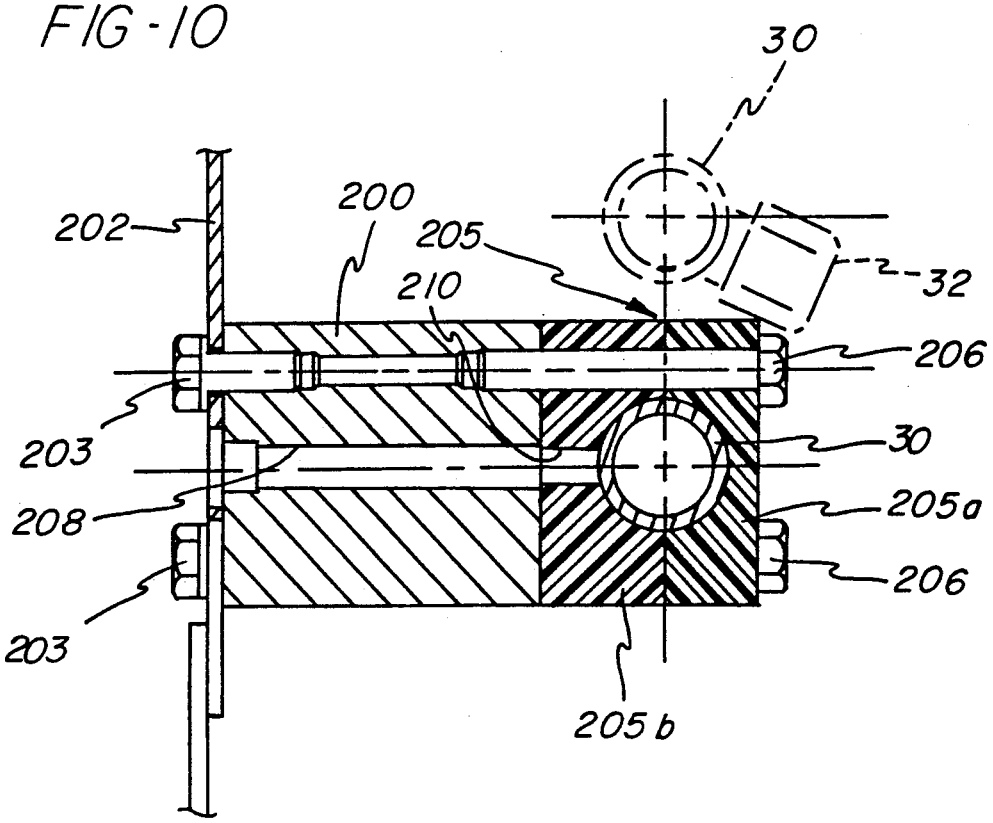
FIG. 10 is an enlarged sectional view through one of the modified support arrangements of FIG. 9, and showing in phantom the relative position of an adjacent conduit pipe.

FIGS. 9 and 10 illustrate an alternative support arrangement by which the conduit pipes may be supported for oscillating movement within the conduit section 11 or otherwise. The apparatus and arrangement shown includes a low friction sliding support which may be used in lieu of the suspension springs 45.

Stand-off supports in the form of light-weight aluminum blocks 200 have base ends mounted to an inside surface of the side wall 202 of the conduit section 11 by bolts 203. Split polymeric bushings or bearings 205 are mounted on the opposite ends of the blocks 200, by bolts 206. The bushings have two parts, 205*a* and 205*b*, each defining one-half of a cylinder opening, which, together, form a close sliding fit about the outer circumference of one of the conduits 30. The bushings are formed of a high density, low friction material, such as nylon or polytetrafluoroethylene.

The stand-off supports are laterally staggered on each side of the conduit section 11, that is, one behind the other, for the upper and lower conduit pipe 30 respectively, and for the sake of clarity, only the relatively supported position of the upper pipe 30 and one its nozzles 32, are shown in broken outline form, on FIG. 10. It will be understood that identical supports may be used for the conduits 30 at each side of the conduit section 11, in lieu of the previously-described suspension springs, to provide for a straight-line or linear reciprocal cutting or shredding movement of the nozzles with respect to the path of movement of the sheet material therebetween.

The modified support of FIGS. 9 and 10 further include provision for the reduction of friction and heat, by water lubrication of the bushings 205. Water or other cooling and lubricating liquid may be brought to the sliding surface of the bushing by a passage 208 through the support 200 and a communicating passage 210 in the bushing half 205*b*.

As previously mentioned, the method and apparatus of this invention, having particular utility as a broke cutter, may also be employed more generally for comminuting a moving continuous sheet of woven or felted web-type material, such as paper, paperboard, fabric, felt, and plastic, as examples, into small discontinuous pieces such as to facilitate disposal or to facilitate further processing of the material. Also, in instances where the moving sheet is relatively rigid or stiff, such as in the case of paper board, no backing or support may be needed, and the sheet may be comminuted by oscillating cutting jets impinging against the sheet at one side of the sheet only. In such instances, the stiffness of the sheet above is sufficient to define its path of movement.

While the forms of apparatus and method herein described constitutes preferred embodiments of this invention, it is to be understood that the invention is not limited to these precise forms of apparatus and method and that changes may be made therein without departing from the scope of the invention which is defined in the appended claims.

What is claimed is:

1. A cutter for receiving a moving sheet, comprising:

a conduit section having an open top positioned to receive a moving sheet and open bottom adapted to discharge cut pieces of such sheet, and defining therein a path for movement of such sheet therethrough to said outlet, a plurality of cutting nozzles transversely spaced on each side of said section and directed to the opposite side thereof across said path, including at least a first pair of banks of such nozzles positioned at one side of said path and a second pair of banks of said nozzles positioned in said section at the opposite side of said path, each such nozzle bank including a supporting water supply conduit and a plurality of nozzles spaced along said conduit in transverse relation to said conduit section, the nozzles in each said bank positioned to direct cutting jets in generally parallel paths across said section to intersect such sheet in said path, said pairs of banks each including an upper bank and a lower bank in which the upper banks are positioned in mutually opposed relation and the lower banks are positioned in mutually opposed relation, means mounting each of said water supply conduits for reciprocating movement in said section, and means moving said upper nozzle banks with a unison transverse reciprocating movement and said lower banks with an unison reciprocating movement which is out-of-phase with the movement of the upper bank to sever such sheet in said path into smaller pieces for discharge through said bottom.

2. The cutter of claim 1 in which at least one pair of said opposed banks of nozzles are angled to impart a force on such sheet passing through said section tending to pull such sheet through said path.

3. A cutter for comminuting a moving continuous sheet of web material, which material is capable of being cut by liquid jet cutting, comprising:

a first bank of a plurality of high pressure water nozzles, means mounting the nozzles of said first bank in mutually spaced relation transversely of the direction of sheet movement, with said nozzles positioned on said first bank to direct cutting streams against one side of such moving sheet passing thereby, a second said bank of a plurality of high pressure water nozzles, means mounting the nozzles of said second bank in mutually spaced relation transversely of the sheet movement with said nozzles of said second bank of nozzles positioned to direct cutting streams against such sheet from the side thereof opposite to said one side with the streams from said second bank impacting said sheet in substantially the same position in relation to said direction of sheet movement as the streams from said first bank, and means moving at least one of said nozzle banks in a transverse reciprocating manner relative to the other to provide said bank to form mutually substantially intersecting cutting paths for reducing said sheet into smaller discontinuous or easily separable pieces.

4. A cutter for receiving and for reducing to small pieces a continuous moving sheet from a roll of a papermaking machine, comprising:

a conduit section adapted to be positioned in underlying relation to an off-running side of a roll and having an open top adapted to be positioned to receive such sheet from such roll and an open bottom adapted to deliver cut sheet material therefrom, and defining therein a path for the movement of such sheet material therethrough to said open bottom, a plurality of water jet cutting nozzles in said conduit section transversely spaced apart and arranged in two banks, one on each side of said section and with the nozzles of each said bank directed to the opposite side of said conduit section across said path, each said nozzle bank further including a supporting water supply conduit and a plurality of said nozzles spaced along said conduit in transverse relation to said conduit section, the nozzles in each said bank being positioned to direct cutting jets in generally parallel paths across said section to intersect such sheet in said path, and means moving one of said nozzle banks in said section with a transverse reciprocating movement with respect to the other nozzle bank, to cut such sheet therebetween in said path into smaller pieces for delivery through said bottom.

5. The cutter of claim 4 in which at least some of said nozzles are angled to impart a force on such sheet material passing through said section tending to pull such sheet material from such roll.

6. The cutter of claim 4 further including means mounting each of said water supply conduits for reciprocating movement in said section, and drive means connected to reciprocate each such water supply conduit in an 180° out-of-phase relation.

7. The cutter of claim 6 in which said mounting means includes strap-type suspension springs, at least two of such springs for each of said water conduits, having one end connected to said conduit section and having an opposite end connected to one of said water conduits.

8. The cutter of claim 6 in which said mounting means includes split polymeric bearings engaging an outer surface of said conduits, and supporting said conduits for sliding movement therethrough.

9. A cutter for comminuting and reducing to small discontinuous or easily separable pieces, moving sheet material such as paper, paperboard, fabric, felt and plastics, for facilitating disposal or reuse thereof, such as repulping in the case of paper or paperboard, comprising:

at least two nozzle sets, each set having a plurality of spaced-apart liquid jet cutting nozzles positioned transversely of the direction of movement of such sheet material, each of said nozzles being adapted to apply a jet cutting stream against said sheet material, means supporting and positioning said nozzle sets in mutually opposed spaced relation to each other and defining therebetween a path for the movement of such sheet material therebetween with one of said nozzle sets positioned at one side of such sheet material path and the other of the sets positioned at the other side of such sheet material so that the jet cutting streams therefrom are directed simultaneously against such sheet material from the opposite sides of such sheet material, such that the jet cutting streams from the nozzles of one of said sets form cutting paths which at least substantially intersect corresponding cutting paths formed by the jet cutting streams of nozzles from the other said nozzle set, and apparatus connected to reciprocate at least one of said nozzle sets transversely of said direction of sheet movement and with respect to the nozzles of the other of said nozzle sets to cause the jet cutting streams therefrom to reduce such sheet material into such small discontinuous or easily separable pieces.

10. The cutter according to claim 9 in which said jet streams from each of said nozzle sets are directed to intercept such sheet material at an angle in a direction to promote movement of such sheet material through said path and along its direction of movement.

11. The cutter according to claim 9 further comprising each of said nozzle sets having the same number of jet cutting nozzles, and means supporting said nozzles of one of said sets so that said cutting streams therefrom intercept such sheet material at approximately the same position in relation to said direction of sheet movement as the cutting streams from nozzles of the other of said nozzle sets.

12. The cutting according to claim 9 in which said apparatus reciprocates each of said nozzle sets relative to each other.

13. A cutter for comminuting and reducing to small discontinuous or easily separable pieces, moving sheet material such as paper, paperboard, fabric, felt and plastics, for facilitating disposal or reuse thereof, such as repulping in the case of paper or paperboard, comprising:

a cylinder having an outer open surface, means supporting said cylinder for rotation, such sheet material being supported on said open surface of said cylinder and forming a cutting region, at least two nozzle sets, each set having a plurality of spaced-apart liquid jet cutting nozzles positioned transversely of the direction of movement of such sheet material, each of said nozzles being adapted to apply a jet cutting stream against such sheet material, means supporting and positioning said nozzle sets to direct their respective jet cutting streams generally along common transverse paths, which paths are coincidental with said cutting region, said means supporting said nozzle sets being positioned such that said cutting streams are directed against such sheet material from a side of such sheet material opposite to the side supported on said cylinder, and apparatus connected to reciprocate at least one of said nozzle sets transversely of said direction of sheet movement and with respect to the nozzles of the other of said nozzle sets to cause the jet cutting streams therefrom to cause the jet cutting streams from the nozzles of one of said sets to form cutting paths which at least substantially intersect corresponding cutting paths formed by the jet cutting streams of nozzles from the other said nozzle set, and to reduce such sheet material into such small discontinuous or easily separable pieces.

* * * * *

UNITED STATES PATENT AND TRADEMARK OFFICE

CERTIFICATE OF CORRECTION

PATENT NO. : 5,234,172

DATED : August 10, 1993

INVENTOR(S) : David E. Chupka, Peter Seifert, Christopher M. Vitori

It is certified that error appears in the above-identified patent and that said Letters Patent is hereby corrected as shown below:

Claim 1, Col. 9, line 31, change "outlet" to --open bottom--.

Claim 12, Col. 12, line 5, change "cutting" to -- cutter --.

Signed and Sealed this

Fifteenth Day of November, 1994

*Attest:*

*Attesting Officer*

Bruce Lehman

BRUCE LEHMAN

*Commissioner of Patents and Trademarks*